US007700866B2

(12) United States Patent
Yanase et al.

(10) Patent No.: US 7,700,866 B2
(45) Date of Patent: Apr. 20, 2010

(54) ELECTRONIC MUSICAL APPARATUS DISPLAYING NETWORK SERVICE ITEMS FOR SELECTION AND COMPUTER PROGRAM THEREFOR

(75) Inventors: Tsutomu Yanase, Hamamatsu (JP); Takeo Shibukawa, Shizuoka-ken (JP)

(73) Assignee: Yamaha Corporation (JP)

( * ) Notice: Subject to any disclaimer, the term of this patent is extended or adjusted under 35 U.S.C. 154(b) by 869 days.

(21) Appl. No.: 11/017,496

(22) Filed: Dec. 20, 2004

(65) Prior Publication Data

US 2005/0155484 A1 Jul. 21, 2005

(30) Foreign Application Priority Data

Dec. 25, 2003 (JP) ..... 2003-429539

(51) Int. Cl.
*G10H 1/00* (2006.01)

(52) U.S. Cl. ..... 84/609; 84/615; 84/649; 84/653

(58) Field of Classification Search ..... 84/609, 84/615, 653, 649
See application file for complete search history.

(56) References Cited

U.S. PATENT DOCUMENTS

| | | | | |
|---|---|---|---|---|
| 6,538,188 | B2 | 3/2003 | Kondo | |
| 6,915,328 | B2 * | 7/2005 | Turnbull | 709/203 |
| 6,931,439 | B1 * | 8/2005 | Hanmann et al. | 709/219 |
| 7,027,172 | B1 | 4/2006 | Parulski et al. | |
| 7,155,425 | B2 * | 12/2006 | Nykanen | 707/3 |
| 2002/0112596 | A1 * | 8/2002 | Kondo | 84/609 |

FOREIGN PATENT DOCUMENTS

| | | |
|---|---|---|
| JP | 7-104751 | 4/1995 |
| JP | 2002-158949 A | 5/2002 |
| JP | 2002-258838 A | 9/2002 |
| JP | 2003-255934 A | 9/2003 |
| JP | 2003-271137 A | 9/2003 |

OTHER PUBLICATIONS

Notification of Reasons for Refusal issued in corresponding Japanese application No. 2003-429539, dated May 7, 2008.
Office Action dated Jan. 20, 2009 issued in corresponding Japanese Patent Application No. 2003-429539. No English translation readily available.
Japanese Office Action issued in corresponding Japanese Patent Application No. 2003-429539, dated Jan. 20, 2009, with English translation.

* cited by examiner

*Primary Examiner*—David S. Warren
(74) *Attorney, Agent, or Firm*—Rossi, Kimms & McDowell, LLP

(57) ABSTRACT

An electronic musical apparatus is of a data processing type and is connectable to an external server via a communication network. The apparatus comprises a display screen, item selecting keys arranged around the display screen, and a communication device to connect with the server via the communication network. The apparatus transmits a connection request to a server, receives a list of available service items from the server, displays the list for selection on the display screen, permits the user to select from the list an intended service by operating the item selecting key, transmits a request of the selected service, and receives from the server the service corresponding to the transmitted request.

5 Claims, 13 Drawing Sheets

Top Plan View around Display Screen

*Fig. 1* System Block Diagram of Electronic Musical Apparatus
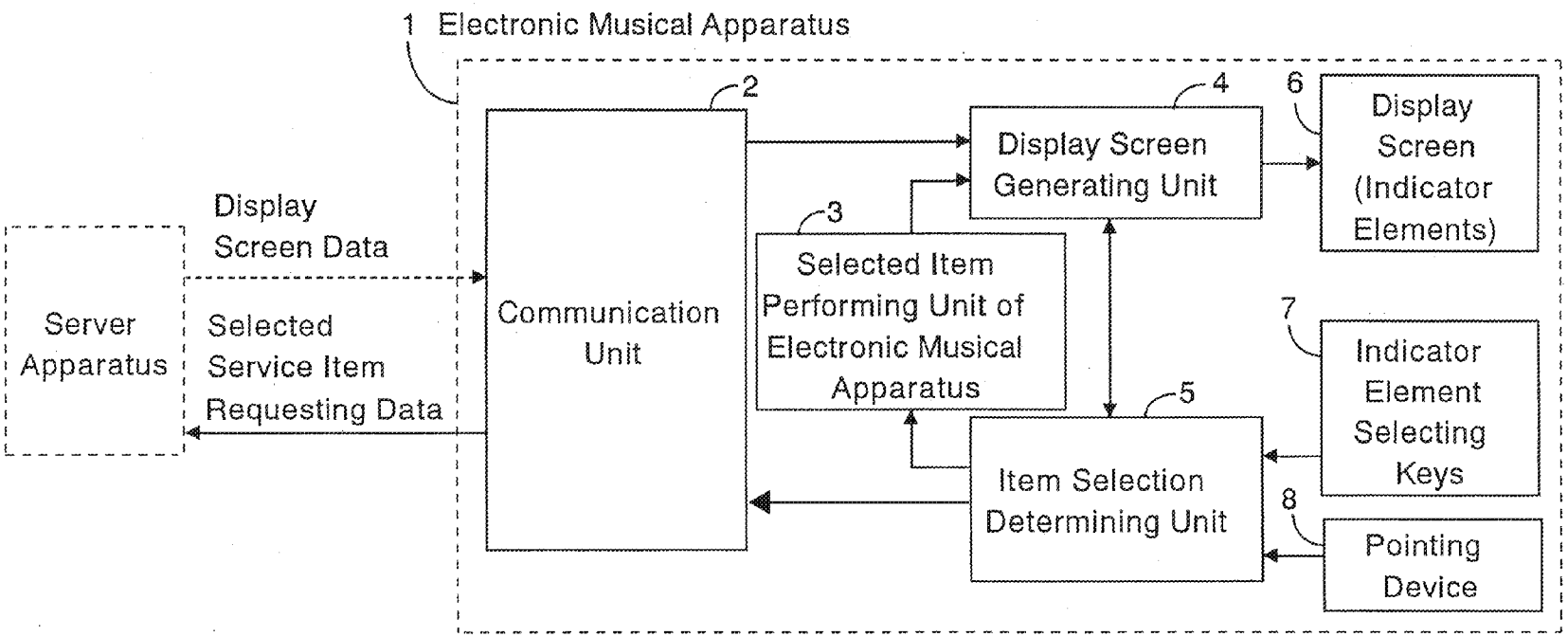

*Fig.2a* Top Plan View of Electronic Musical Apparatus
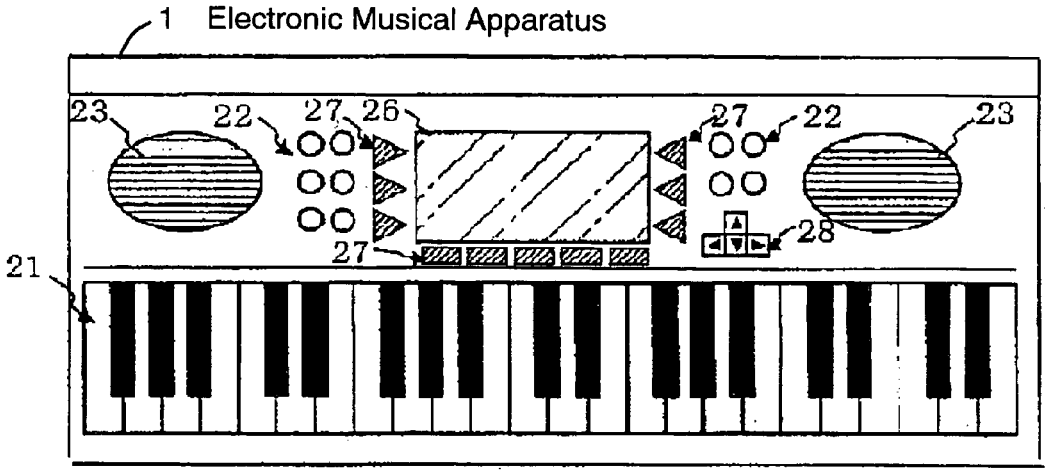

*Fig. 2b* Top Plan View around Display Screen
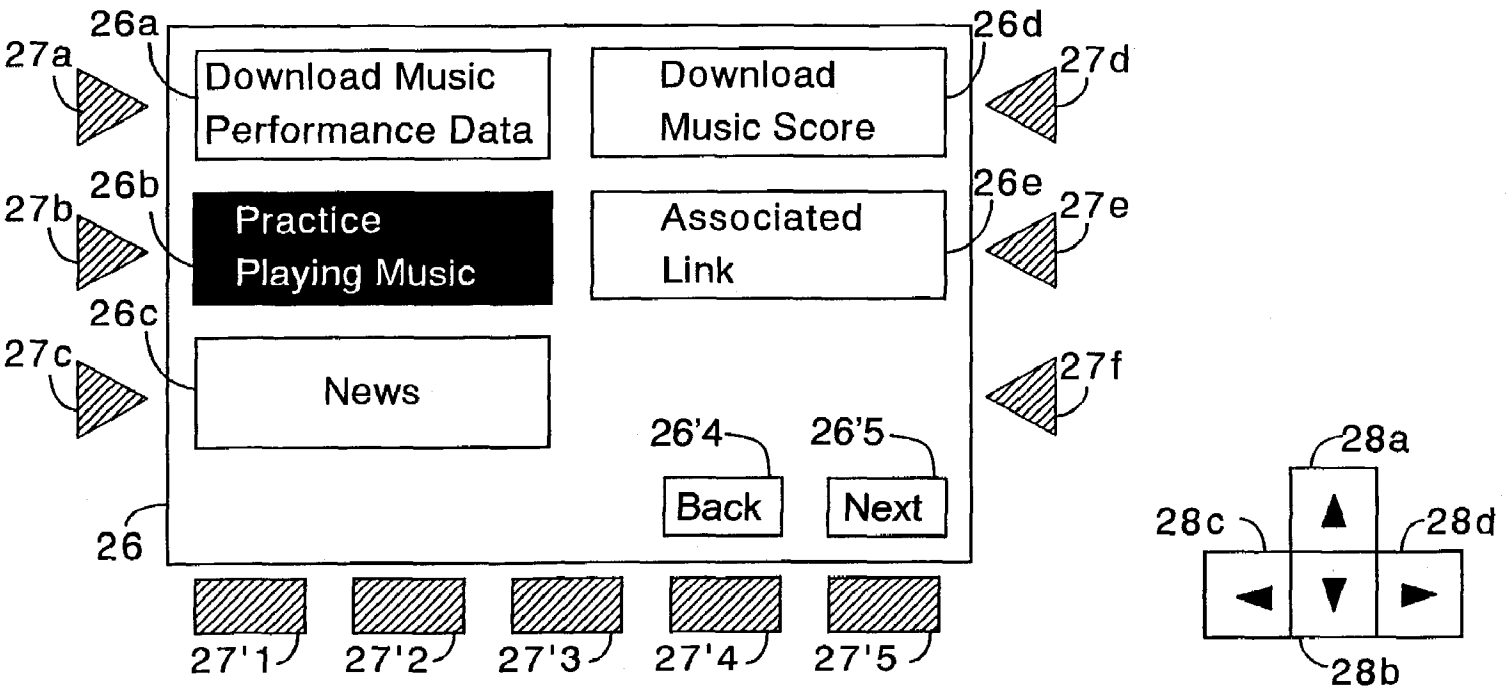

*Fig.3a*

ID Data ↓ ↓ User's Name ↑ History, Display Screen Data, etc. ↑

| Apparatus and User Administrative Information | | | |
|---|---|---|---|
| Electronic Musical Apparatus ID | User ID | User's Name | History/Display Screen Data/Others |
| A-123 | 0001 | YAMADA, Ichiro | ···/···/····· |
| B-256 | 0002 | SATO, Hanako | ···/···/····· |
| B-077 | 0003 | SUZUKI, Taro | ···/···/····· |
| ⋮ | ⋮ | ⋮ | ⋮ |

*Fig.3b*

Present Time-of-Day ↓ Voice Message Responding Unit ↑

| Time-of-Day | Greeting |
|---|---|
| 3:00～10:00 | Good Morning |
| 10:00～17:00 | Good Day |
| 17:00～3:00 | Good Evening |

*Fig. 4a* Hardware Configuration of Electronic Musical Apparatus
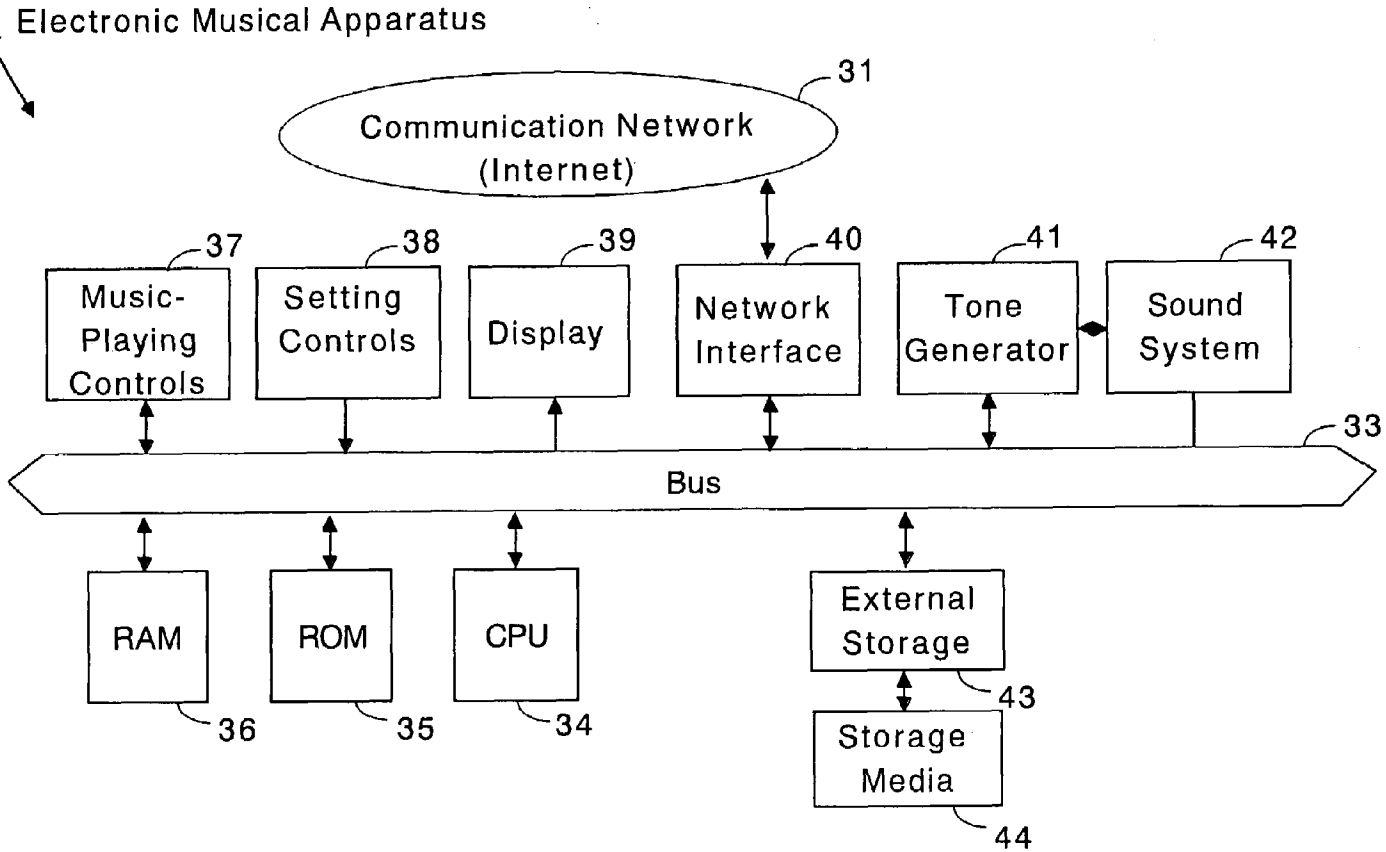

*Fig. 4b* Hardware Configuration of Server Apparatus
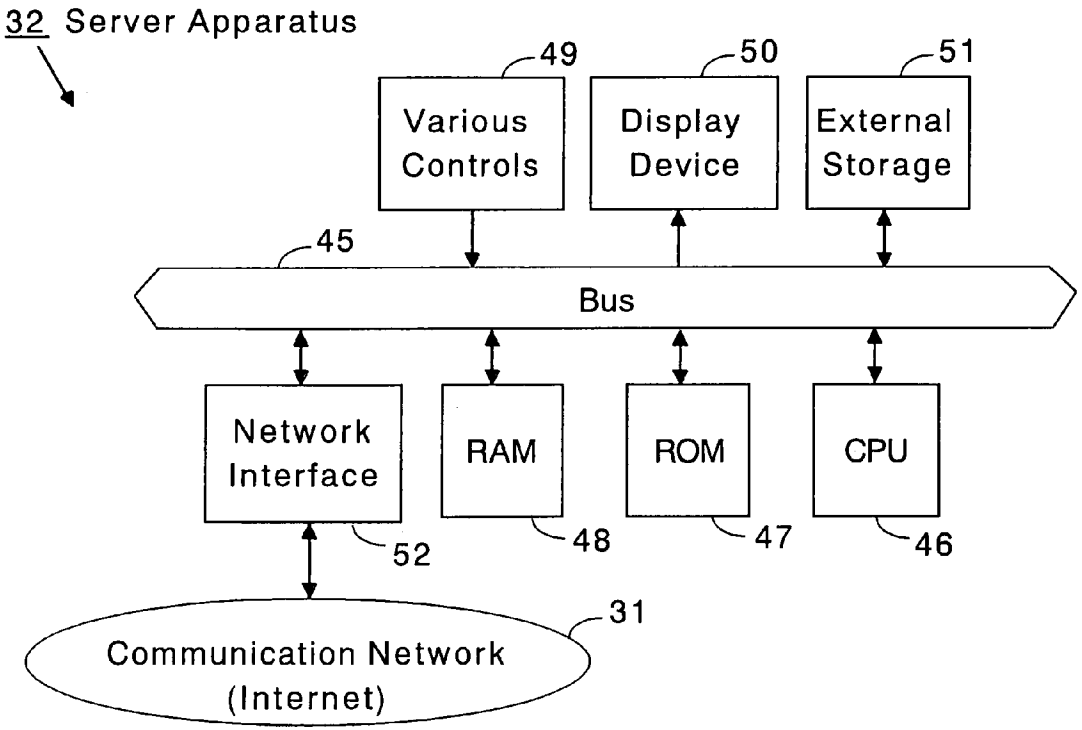

*Fig. 5a* Server Apparatus Processing (Part 1)
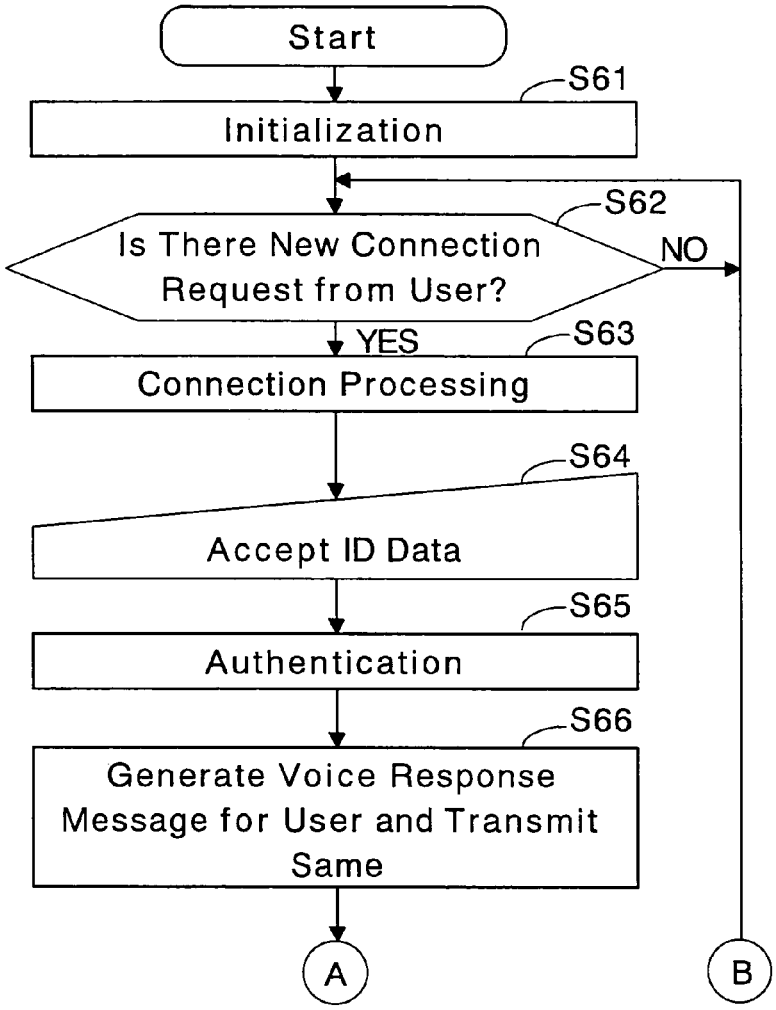

*Fig. 5b* Server Apparatus Processing (Part 2)
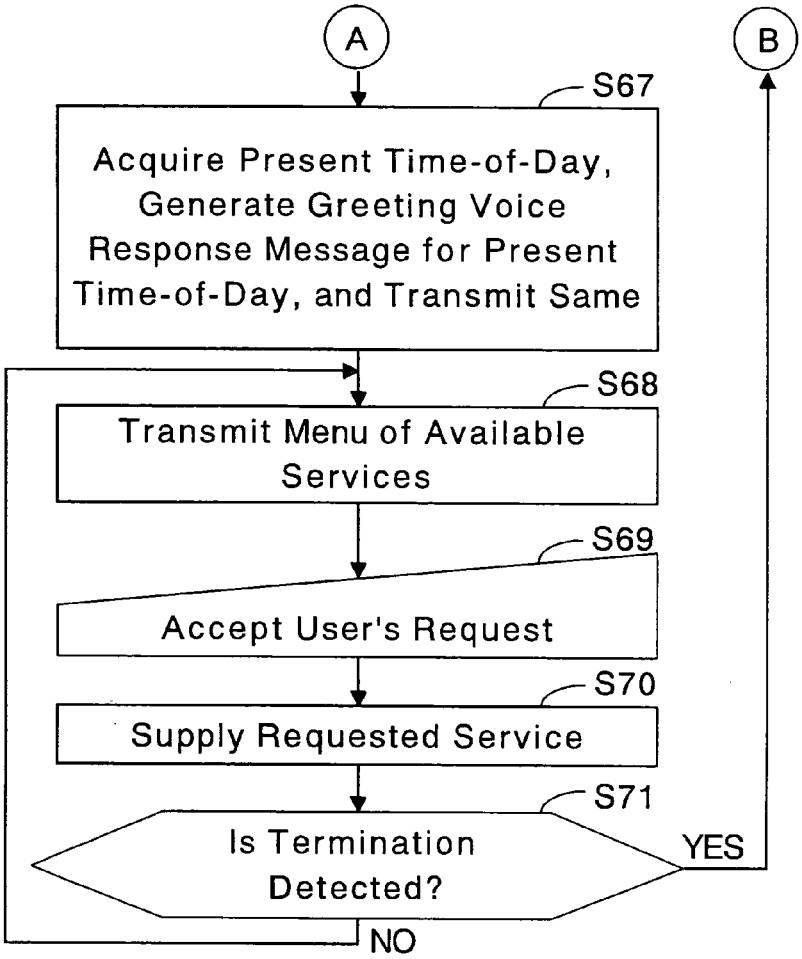

*Fig. 6a* Electronic Musical Apparatus Processing (Part 1)
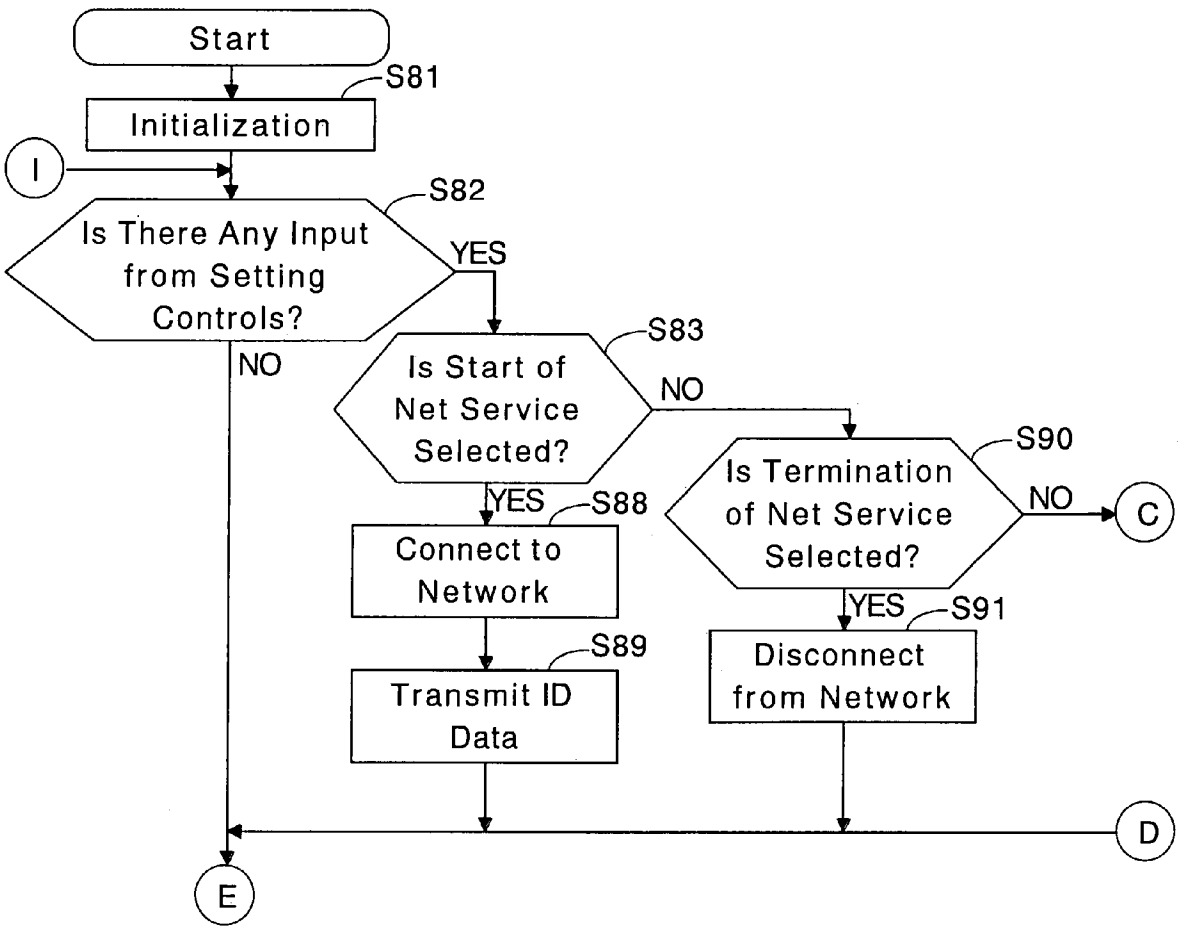

*Fig. 6b* Electronic Musical Apparatus Processing (Part 2)
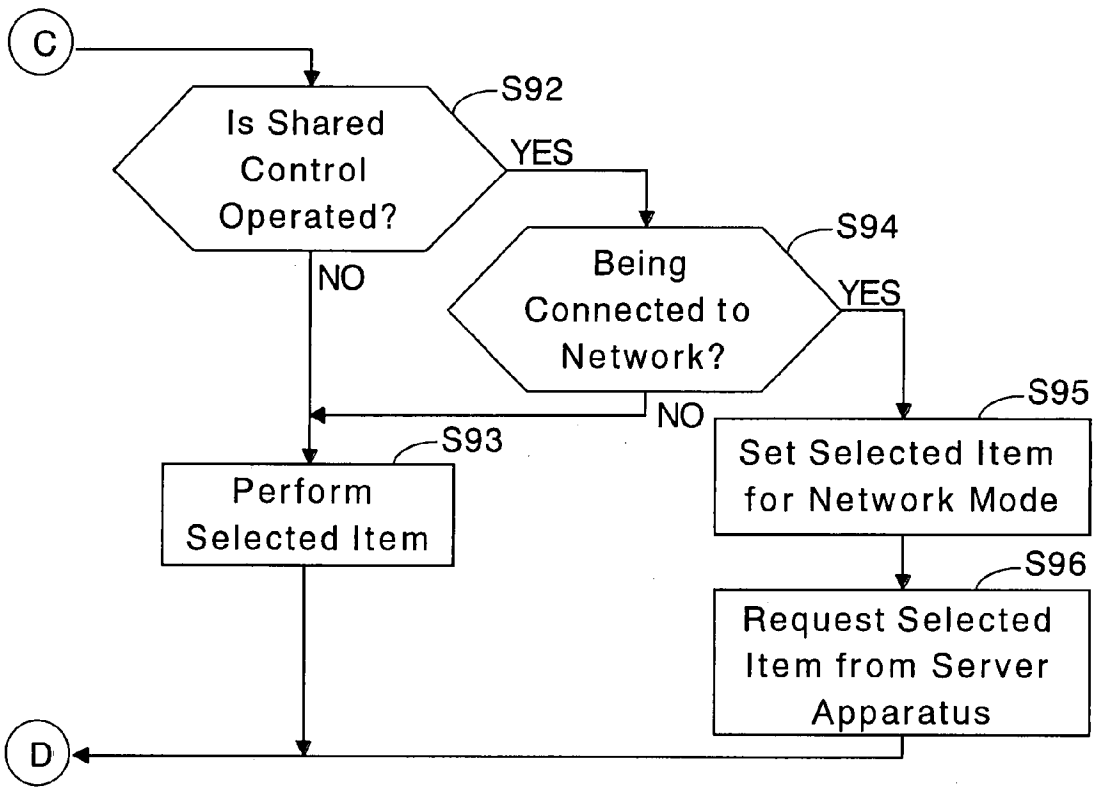

*Fig. 6c* Electronic Musical Apparatus Processing (Part 3)
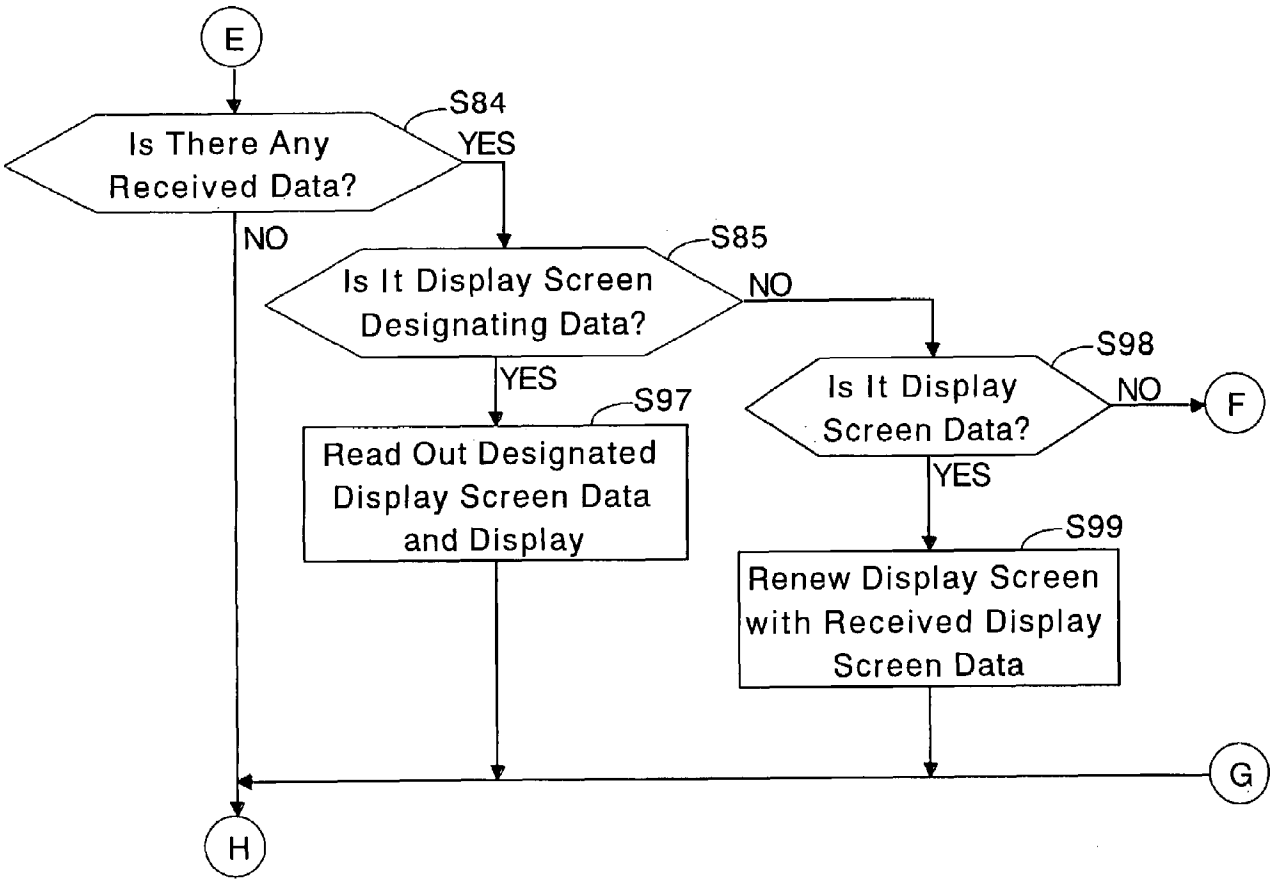

*Fig. 6d* Electronic Musical Apparatus Processing (Part 4)
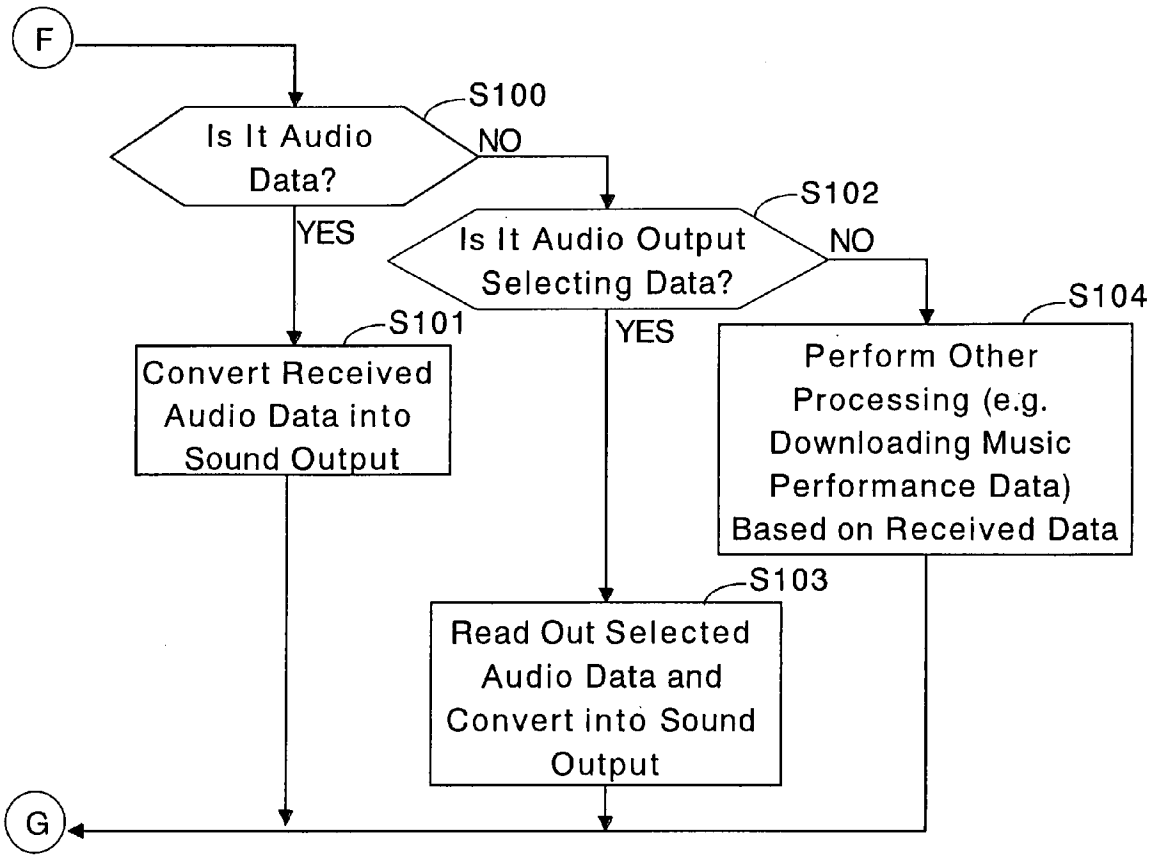

*Fig. 6e* Electronic Musical Apparatus Processing (Part 5)
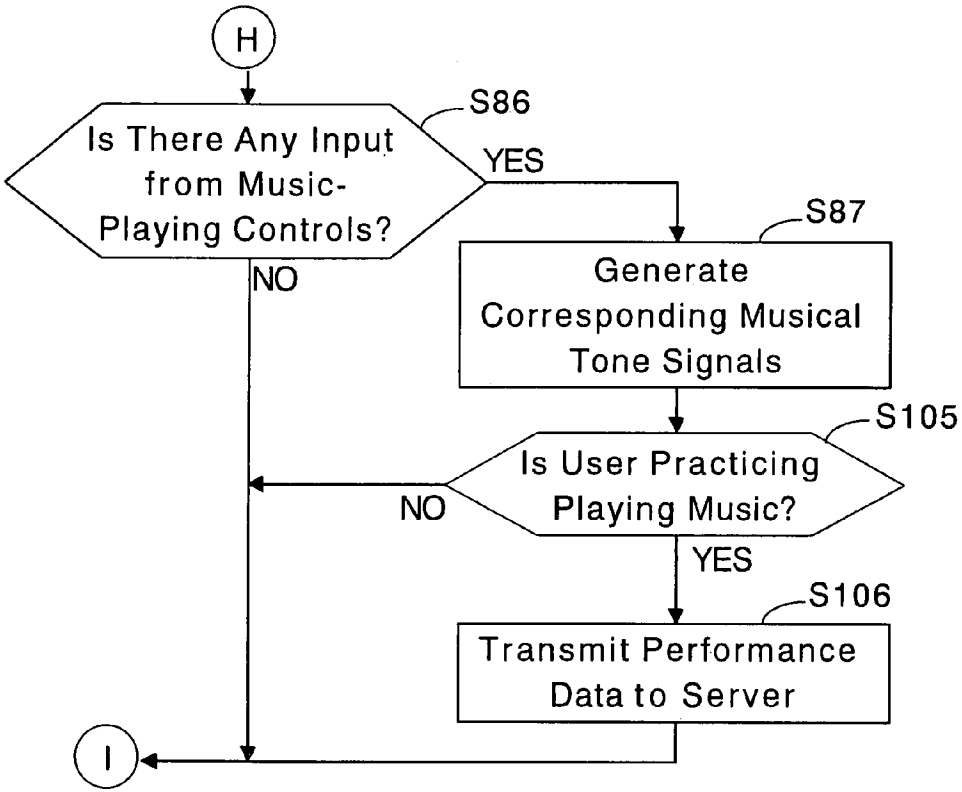

ELECTRONIC MUSICAL APPARATUS DISPLAYING NETWORK SERVICE ITEMS FOR SELECTION AND COMPUTER PROGRAM THEREFOR

TECHNICAL FIELD

The present invention relates to an electronic musical apparatus connectable to a communication network as a client apparatus for requesting and receiving services from an external server apparatus, and a computer program for realizing such an apparatus using a computer system, and more particularly to a client apparatus in which a menu of selectable services available from an external server apparatus are displayed on a display screen of the client apparatus, the user selects and requests an intended service from the server apparatus, and the server apparatus transmits the requested service to the client apparatus.

BACKGROUND INFORMATION

In order for a conventional electronic musical apparatuses to receive a service from a server apparatus on a communication network, the electronic musical apparatus should be connected by a cable to a personal computer, which in turn accesses the server apparatus via the communication network. Recently, however, there are desires among users that an electronic musical apparatus be able to make an access to a server apparatus on the communication network and receive services therefrom without the aid of a personal computer. In order to meet such desires, an electronic musical apparatus per se should be provided with functions of displaying screen images based on the screen image data as generated by and supplied from the server apparatus. For example, such functions may include a Web site browsing function to look into Web (World Wide Web) pages created using, for example, the Hypertext Markup Language. See unexamined Japanese patent publication No. 2003-255934.

However, the display screen of an electronic musical apparatus is usually of such a small area as compared with the display screen of a personal computer that a conventional Web page would be almost illegible on the display screen. In addition, a conventional electronic musical apparatus is not equipped with a mouse control so that the user should move the pointer on the screen using cursor keys. Thus, the operation on the screen of the apparatus to designate the URL (uniform resource locator) of the link destination would be accordingly hard in accessing the link destination to fetch the intended data to exhibit the Web page content on the display screen based on the fetched data.

On the other hand, some of the electronic musical apparatuses employ a GUI (graphical user interface) system for the user to control the apparatus by designating intended functions or operations of the apparatus. With such a GUI system, indication elements of graphical representations of options are displayed for selection on the display screen so that the user can select an intended one by visually recognizing the displayed indication elements and by operating the selecting control (e.g. a selecting key) located near (i.e. corresponding to) the intended indication element on the display screen.

SUMMARY OF THE INVENTION

It is, therefore, a primary object of the present invention to solve the above described drawbacks with the conventional electronic musical apparatus and to provide a novel type of electronic musical apparatus and a computer program for realizing such an apparatus using a computer system, in which the electronic musical apparatus can access an external server apparatus via a communication network, request a menu of services from the server apparatus, select an intended service out of the menu with the aid of a GUI system, and request and fetch the selected service from the server apparatus, with simple and easy operations by the user on the electronic musical apparatus.

According to the present invention, the object is accomplished by providing an electronic musical apparatus connectable to a communication network for transmitting and receiving data through the communication network, the apparatus comprising: a display screen having peripheral edges; a plurality of selecting controls arranged in the vicinity of the peripheral edges of the display screen; a display screen image generating device which generates a screen image to be displayed on the display screen, the screen image containing indicator elements correspondingly exhibited near the selecting controls for selection by a user of the apparatus; an item selection determining device which determines an item to be conducted according to the selection by the user from among function items representing functions to be performed by the electronic musical apparatus and service items representing services to be given through the communication network to the electronic musical apparatus; and a communication device which transmits a connection request to a server apparatus on the communication network, receives available service items from the server apparatus and causes the display screen image generating device to generate the screen image of the indicator elements for selection of a service available from the server apparatus, transmits to the server apparatus a request of service represented by the service item as selected by the user, and receives from the server apparatus the service corresponding to the transmitted request.

In an aspect of the present invention, the indicator elements are allocated with the function items individually, wherein an intended function item is selected by operating the selecting control arranged near the corresponding indicator element representing the intended function item. According to this aspect of the invention, the functions of the electronic musical apparatus are individually selectable by means of the correspondingly arranged selecting controls.

In another aspect of the present invention, the indicator elements are allocated with the service items individually, wherein an intended service item is selected by operating the selecting control arranged near the corresponding indicator element representing the intended service item. According to this aspect of the invention, the services from the server apparatus are individually selectable at the electronic musical apparatus side by means of the correspondingly arranged selecting controls.

In a still other aspect of the present invention, the indicator elements are provided for sequentially exhibiting the function items one after another using a roller or wheel selector (e.g. a jog dial) or a next key and a back key, wherein an intended function item is selected by designating the exhibited one of the function items. According to this aspect of the invention, the functions of the electronic musical apparatus are sequentially selectable without the need of providing individual selecting controls.

In a still further aspect of the present invention, the indicator elements are provided for sequentially exhibiting the service items one after another using a next key or a back key, wherein an intended service item is selected by designating the exhibited one of the service items. According to this aspect of the invention, the services from the server apparatus are sequentially selectable at the electronic musical apparatus side without the need of providing individual selecting controls.

In a still further aspect of the present invention, the electronic musical apparatus further comprises a pointing device which causes a pointer to move in the screen image, wherein the communication device receives data for a screen image including an embedded link destination, causes the display screen image generating device to display a screen image including the embedded link destination, causes the item selection determining device to determine the embedded link destination as the selected item when designated by the pointer, and permits access to the determined link destination. According to this aspect of the invention, the user can easily make an access to a link destination using a pointing device such as a mouse control.

In a still further aspect of the present invention, the communication device transmits an identification code of the electronic musical apparatus and an identification code of a user of the electronic musical apparatus to an external server apparatus thereby permitting the server to authenticate the accessing electronic musical apparatus and its user. According to this aspect of the invention, an electronic musical apparatus and its user can be easily authenticated at the server apparatus side.

In a still further aspect of the present invention, the communication device receives from the external server apparatus data for a screen image permitted by the external server apparatus according to the authentication of at least either one of the identification code of the electronic musical apparatus and the identification code of the user of the electronic musical apparatus. According to this aspect of the invention, a server will transmit requested screen image data to the authenticated electronic musical apparatus or the user, thereby ensuring the security in data delivery.

According to the present invention, the object is further accomplished by providing a storage medium for use in an electronic musical apparatus of a data processing type including a processor, a display screen having peripheral edges, a plurality of selecting controls arranged in the vicinity of the peripheral edges of the display screen, and a communication device connectable to a communication network for transmitting and receiving data through the communication network, the medium containing a set of executable instructions for causing the processor to perform the steps of: generating a screen image to be displayed on the display screen, the screen image containing indicator elements correspondingly exhibited near the selecting controls for selection by a user of the apparatus; determining an item to be conducted according to the selection by the user from among function items representing functions to be performed by the electronic musical apparatus and service items representing services to be given through the communication network to the electronic musical apparatus; transmitting a connection request to a server apparatus on the communication network; receiving available service items from the server apparatus; causing the step of generating a screen image to generate the screen image of the indicator elements for selection of a service from the server apparatus; transmitting a request of service represented by the service item as selected by the user to the server apparatus; and receiving from the server apparatus the service corresponding to the transmitted request.

According to the present invention, an electronic musical apparatus can be easily connected to an external server apparatus through a communication network and the user can utilize various services provided from the external server apparatus by easy selecting operations. A GUI system in an electronic musical apparatus can be used not only for the selection and the designation of the functions of the electronic musical apparatus per se (e.g. tone color setting and automatic performance control) but for the selection and the request of services available from a Web site on a communication network. Further, an electronic musical apparatus can access a desired link destination by operating a pointing device at the electronic musical apparatus side.

As will be apparent from the description herein later, some of the structural element devices of the present invention are configured by a computer system performing the assigned functions according to the associated programs. They may of course be hardware structured discrete devices. Therefore, a hardware-structured device performing an intended function and a computer-configured arrangement performing the same function should be considered a same-named device or an equivalent to each other.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram illustrating the system configuration of an embodiment of an electronic musical apparatus according to the present invention;

FIG. 2*a* is a top plan view of an embodiment of an electronic musical apparatus according to the present invention;

FIG. 2*b* is a top plan view of the portion including a display screen of the embodiment of FIG. 2*a;*

FIG. 3*a* is a table showing administrative information about client apparatuses and users;

FIG. 3*b* is a table showing greeting voice messages used depending on the time of day;

FIG. 4*a* is a block diagram illustrating the hardware configuration of an embodiment of an electronic musical apparatus according to the present invention as connected to a communication network;

FIG. 4*b* is a block diagram illustrating the hardware configuration of an embodiment of a server apparatus according to the present invention as connected to the same communication network as FIG. 4*a;*

FIGS. 5*a* and 5*b* are, in combination, a flow chart describing an example of the operation of a server apparatus as an embodiment of the present invention; and FIGS. 6*a*, 6*b*, 6*c*, 6*d* and 6*e* are, in combination, a flow chart describing an example of the main routine operation of an electronic musical apparatus as an embodiment of the present invention.

DETAILED DESCRIPTION OF EMBODIMENTS OF THE INVENTION

Herein below will be described an embodiment of the present invention with reference to accompanying drawings. FIG. 1 shows a block diagram illustrating the system configuration of an embodiment of an electronic musical apparatus according to the present invention. An electronic musical apparatus 1 is, for example, of a type of a keyboard electronic musical instrument, and comprises a communication unit 2, a selected item performing unit of the electronic musical apparatus 3, a display screen image generating unit 4, an item selection determining unit 5, a display screen 6, indicator element selecting controls (i.e. keys or buttons) 7 and a pointing device 8.

The communication unit 2 is a kind of transmitter-receiver unit to be connected to a communication network for accessing a server apparatus on the communication network, and downloading music performance data and music score data, or transmitting music performance data to conduct a streaming playback. The user may take lessons from the server apparatus, transmit the music-playing data of the user's practice, and receive an evaluation report of the user's music-playing from the server apparatus. The selected item performing unit 3 performs inherent functions of the conventional electronic musical apparatus as selectively designated (controlled) by the user.

The display screen image generating unit 4 generates screen image data to display on the display screen 6 a screen image containing a plurality of indicator elements (GUI elements such as buttons) each of which indicates each of the allocated function items. Around the display screen 6, that is, along or in the vicinity of the peripheral edges of the display screen 6, there are provided on the panel of the electronic musical apparatus 1 a plurality of selecting keys 7 at locations respectively corresponding to the respective indicator elements on the display screen 6. The item selection determining unit 5 determines an item to be conducted from among the function items to be performed by the electronic musical apparatus according to the selection or designation by the user operating an intended selecting control corresponding to the indication element representing the intended function. The display screen image generating unit 4 and the item selection determining unit 5 are connected with each other and cooperatively constitute the GUI system. The indication elements on the display screen 6 and the selecting keys 7 are respectively and correspondingly correlated to each other. While the display screen 6 exhibits the indication elements representing respective items, the user can designate an intended item by operating the corresponding indicator element selecting key 7.

The item selection determining unit 5 transfers data which identifies the indicator element selecting key 7 operated by the user to the display screen image generating unit 4, which in turn generates screen image data to highlight the corresponding indicator element is selected (i.e. designated) such as by reversing the sign of the button (i.e. indicator element). In the illustrated embodiment, the data representing the operations of the pointing device and the click button are transferred to the display screen image generating unit to determine the location of the pointer (e.g. the arrow mark) on the display screen. The display screen image generating unit 4 transfers the location data of a plurality of indicator elements on the display screen to the item selection determining unit 5, which detects on which indicator element the pointer is placed and changes the displayed condition of the selected item.

The communication unit 2 receives, for example, data for generating display screen images in the format which includes a plurality of indicator elements each being allocated with each of the available services from the external server apparatus for selection at the electronic musical apparatus side. The communication unit 2 causes the display screen image generating unit 4 to generate a screen image in the format which includes the indicator elements according to the received data, namely, a plurality of indicator elements respectively allocated with available services from the external server apparatus for selection, which are displayed on the display screen 6. The display screen image generating unit 4 also causes the item selection determining unit 5 to determine the selected service item allocated to the selected indicator element in response to the operation of the corresponding indicator element selecting key 7. The communication unit 2 requests the thus determined selected service item from the external server apparatus.

The display screen image data may be described in, for example, the HTML (hypertext markup language) just like the general Web pages. The display screen image data may preferably include data to specify the display screen format defining the size of the display screen 6 and the physical arrangement of the indicator elements depending on the number and the locations of indicator element selecting keys 7 and data to determine the service selection items (names of items and URL's of link destinations) respectively allocated to the respective indicator elements.

On some occasions, however, the communication unit 2 may receive such data as will generate display screen images in the form of the general Web pages in which URL's of link destinations are embedded and not in the form containing a plurality of indicator elements to each of which is allocated each of the selectable service items which are available from the external server apparatus. The communication unit 2 causes the display screen image generating unit 4 to generate display screen images according to the received data for the display screen to display such screen images. The user operates the pointing device 8. The communication unit 2 causes the item selection determining unit 5 to move the pointer on the display screen in accordance with the user's operation of the pointing device, and determines the URL of the link destination embedded at the location of the pointer. The communication unit 2 will access the Web page of URL of the designated link destination, and the accessed Web page will supply the selected service.

There are several ways of how and where to prepare the display screen image data forming the format of the indication elements allocated with selectable service items in connection with the display screen image generating unit 4. Three examples are as follows.

Firstly, the display screen image data are stored at the server apparatus side, as described above. There may be stored plural sets of such data for individual electronic musical apparatuses 1, respectively.

Secondly, the display screen image data are divided into two groups, the one about the format of the screen image and the other about the selectable service items (names of services and URL's of link destinations), wherein data of one or more screen image formats are stored in the electronic musical apparatus 1 while data of available services are store in the server apparatus. The server apparatus will transmits the data about the available services to the electronic musical apparatus. In the case where there are plural screen image formats, the server apparatus will transmits data for designating one screen image format to the electronic musical apparatus 1 in addition to the data of available services to be allocated to the respective indicator elements.

Thirdly, the above-mentioned display screen image data may be stored in the electronic musical apparatus 1. There can be different sets of screen image data for different types of electronic musical apparatuses 1, in which each type of electronic musical apparatus stores a set of screen image data which is appropriate for the type. However, at least either of the screen image format data and the service item data (to be allocated to the indication elements) are preferably be made determinable at the server apparatus side, which would be convenient for the maintenance of the changes in screen format and/or in selectable service items.

In place of supplying a common display screen image format and a common selectable service items to a plurality of client electronic musical apparatuses 1, the server apparatus may administer different sets of display screen image data (of screen formats and selectable service items) adapted for different models of electronic musical apparatuses 1 and different users using ID data. Specific examples will be described herein later with reference to FIG. 3*a*. The communication unit 2 has an ID data notifying device which has a function of notifying the ID data of its own electronic musical apparatus 1 to a server apparatus. The server apparatus will refer the notified ID data to the administrative data file and can supply proper display screen image data having a screen format and selectable service items adapted for the requesting electronic musical apparatus 1 (and its display device, etc.). The server apparatus can also supply display screen image data of the screen format adapted for the user currently using the electronic musical apparatus 1, and also screen image data considering the service items to meet preferences, performance skills, etc. of the respective users.

FIG. 2*a* is a top plan view of an embodiment of an electronic musical apparatus according to the present invention and FIG. 2*b* is a top plan view of the portion including a display screen of the embodiment of FIG. 2*a*.

In FIG. 2*a*, the electronic musical apparatus 1 comprises a keyboard 21 on which the user plays music, various controls 22 dedicated for controlling the electronic musical apparatus itself, loudspeakers 23, a display screen 26, a plurality of indicator element selecting keys (controls) 27 and cursor keys 28. The indicator element selecting keys (controls) 27 are arranged along and in the vicinity of the peripheral edges of the display screen 26. These indicator element selecting keys 27 are solid (not image). These keys are used in common as the controls for the operational mode of electronic musical apparatus per se and as the controls for the network mode to receive services from server apparatuses.

As shown in the enlarged top plan view of FIG. 2*b* around the display screen 26, indicator element selecting keys 27*a*, 27*b* and 27*c* are arranged along and in the vicinity of the left side edge of the display screen 26, indicator element selecting keys 27*d*, 27*e* and 27*f* along and in the vicinity of the right side edge, and indicator element selecting keys 27'1, 27'2, 27'3, 27'4 and 27'5 along and in the vicinity of the bottom edge. On the display screen 26 are exhibited indicator elements 26*a*, 26*b*, 26*c*, 26*d*, 26*e*, 26'4 and 26'5. In the embodiment of FIG. 2*b*, selectable service items respectively allocated to these indicator elements are shown within the frames of the respective indicator elements, i.e. selecting buttons. The respective ones of the indicator elements 26*a*-26*e* and 26'4, 26'5 correspond to the respective ones of the indicator element selecting keys 27*a*-27*e* and 27'4, 27'5, and are located closest to the corresponding ones, respectively. In the illustrated screen page, there are no indicator elements (buttons) to correspond to the indicator element selecting keys 27*f* and 27'1-27'3. This example is of the page at the beginning of the network service utilizing operation. The shown examples of the selectable service items are "Download Music Performance Data," "Practice Playing Music," "News," "Download Music Score" and "Associated Link."

When the indicator element selecting key 27*b* is depressed, the indicator element 26*b* is highlighted, for example, by reversing the sign (or symbol) as shown in FIG. 2*b* in order to visually notice the user that the indicator element 26*b* is selected (designated). Highlighting may be otherwise, such as by red thick framing (focusing) and by blinking. The selected item can be affirmed or entered, for example, by double clicking the selecting key, or by clicking separately provided "OK" button or "Enter" button, which may be solid ones near the display screen or may be exhibited buttons in the screen image.

The indicator elements 26'4 and 26'5 are allocated with selectable items "Back" and "Next." When the "Back" button is selected, the screen image is turned back to the preceding page, and when the "Next" button is selected, the screen image is turned forward to the succeeding page. Different pages will exhibit different contents of images in connection with the locations of the indicator elements and the allocated items. Thus, the indicator elements 26'4 and 26'5 are of selectable items to change locations of the indicator elements and allocated selectable items to the indicator elements. While the above described explanation has been about the case where the screen images for the selectable service items with respect to a server apparatus and the screen images for the function items with respect to an electronic musical apparatus per se are separate from each other, both kinds of items may be included in a single screen image in an intermingled fashion.

Alternatively, the display screen 26 may be provided with a plurality of transparent overlay pieces of touch switches on the surface of the screen to work as the indicator element selecting controls. When the user touches such a touch switch, the indicator element just beneath the touch switch is selected. Further, in place of individually selecting the indicator elements, the indicator elements may be sequentially selected jumping one after another, for example, by using a roller or a wheel control (e.g. a jog dial). Or a push button type switch may be employed to sequentially shift the indicator elements to be selected one after another every time the push button switch is pushed. In such a sequence, the indicator elements are highlighted one after another in a predetermined order, and the "Enter" button determines the selection item which is allocated to the presently highlighted indicator element to be the selected item.

In some occasions, the electronic musical apparatus may receive data to form a screen image which is not of the format having a plurality of indicator elements from a Web site. In such an occasion, the user will actuate the cursor keys 28*a*, 28*b*, 28*c* and 28*d* as the pointing device 8 of FIG. 8. By moving the pointer leftward, rightward, upward or downward bit by bit to place the pointer on an intended indicator element. Then the user clicks the enter button to determine a selected item depending on the location of the pointer. Other than the cursor keys 28*a*-28*d*, a mouse device, a track ball, or a tablet may be employed.

The pointing device 8 may be used to select the indicator elements 26*a*-26*e* and 26'4, 26'5. The pointer can be placed on an intended indicator element and then the "Enter" button will be clicked. In the case of using the cursor keys, the cursor keys may be so arranged to jump to the next indicator element leftward, rightward, upward or downward one after another every time the cursor key is depressed according to the direction of the cursor key. The selection will be affirmed by the "Enter" key.

FIG. 3*a* shows a table of administrative information about client apparatuses and users. A server apparatus stores information about electronic musical apparatuses and users and administer the same in order to supply services to a plurality of client electronic musical apparatuses through a communication network. Specific examples of administering a plurality of client electronic musical apparatus and a plurality of users will be described herein below with reference to FIG. 3*a*. In the illustrated example, data for identification are electronic musical apparatus ID's and user ID's.

The electronic musical apparatus ID is a unique ID to identify an individual electronic musical apparatus. For example, as shown in FIG. 3*a*, each of the unique codes consists of a model code (e.g. A, B, . . . ) and a serial number within each model in combination (e.g. A-256, B-077, . . . ).

However, in the case where the administration with respect to the models is sufficient, the electronic musical apparatus ID may consists of a model code only. The user Id is a unique ID to identify an individual user. In the case where the administration with respect to the user is sufficient, the user ID is enough and the electronic musical apparatus ID is not necessary. In the illustrated case, the electronic musical apparatus ID contains a serial number of the model, and accordingly, if only one user will be cataloged for each electronic musical apparatus, the electronic musical apparatus ID may be used as the user Id to identify the user.

With respect to each ID entry (in the illustrated case, a combination of electronic musical apparatus ID and user ID), the catalog contains a user name, a history, display screen data, and others such as a user's sex, a user's address, user's liking for administration. The user's name, the service utilization history, the sex, the address, the liking are inherent user information about the individual user. The display screen data contain information about the display screen size, the number and the locations of indicator element selecting keys, which information are information inherent to the model of the electronic musical apparatus. However, if the display screen size is determined to meet the user's preference, the screen size information may be also deemed as user inherent information.

Some server apparatuses may not store the display screen image data per se, but store other data such as data to designate the screen image data. Some electronic musical apparatuses may comprise their own administering unit to administer the apparatus information and the user information and stores information in connection with the model and information in connection with the user(s) such as the ID data, the user's name(s), the history, the display screen image, and so forth. In such a case, the server apparatus may not administer information in connection with the model and information in connection with the user(s).

With respect to an electronic musical apparatus, the electronic musical apparatus ID and the user ID may sometimes be notified at the time the user applies for product registration on line or off line, or may sometimes be pre stored in the electronic musical apparatus at the time of shipment of the product.

With respect to a server apparatus, the user's name will be acquired at the time of product registration to the server, and stored in the server apparatus as the apparatus and user administrative information. With respect to the display screen image data, the display screen image data which meet the model may be selected by referring to the database of the electronic musical apparatus using the electronic musical apparatus ID, or the display screen image data may be selected by the user according to the user's preference from among the candidates of display screen image data which meet the model, and thus selected display screen image data may be stored as the apparatus and user administrative information. Or the display screen image data may be obtained by referring to the database in case of necessity.

FIG. 3*b* shows a table of greeting voice messages used depending on the time of day. A response to a user's access to the server apparatus is made by a voice message. The server apparatus acquires the ID data and accepts a request for service, and, in response thereto, acquires, for example, the user's name from the apparatus and user administrative information shown in FIG. 3*a*. Then, the server apparatus acquires the present time-of-day, and determines a proper greeting depending on the time zone with reference to the table of FIG. 3*b*. The server apparatus combines these kinds of information and composes a greeting like, "Good morning, Mr. Yamada." in a voice message, and transmits this voice message to the requesting client electronic musical apparatus. The message will be sounded at the client side.

Now herein below, a detailed explanation will be made as to how an electronic musical apparatus according to the present invention works when it accesses a server apparatus on a communication network. FIG. 4*a* is a block diagram illustrating the hardware configuration of an embodiment of an electronic musical apparatus according to the present invention as connected to a communication network, and FIG. 4*b* is a block diagram illustrating the hardware configuration of an embodiment of a server apparatus according to the present invention as connected to the same communication network as FIG. 4*a*. Thus, FIGS. 4*a* and 4*b* constitute, in combination, a communication network system establishing a client-server relation, in which the client electronic musical apparatus 1 is connected to the server apparatus 32 via the network 31 to receive a service supplied from the server apparatus 32.

As shown in FIG. 4*a*, a CPU (central processing unit) 34, a ROM (read-only memory) 35 and a RAM (random access memory) 35 are connected with each other via a bus 33. The CPU 34 controls overall operations of the system, using control programs and various preset data of the electronic musical apparatus 1 as stored in the ROM 35 and utilizing the RAM 36 as working areas for data processing. The control programs may include an operating system program to be installed in the apparatus, application programs for realizing the functions of the electronic musical apparatus and application programs for utilizing net services such as Web page browsing and contents downloading on the communication network.

The CPU 34 detects operation events of music-playing controls 37 (these correspond to the keyboard 21 of FIG. 2*a*) via the bus 33 and creates music-playing data to supply to a tone generator 41. The CPU 34 also detects operation events of setting controls 38 (these correspond to the various controls 22 dedicated for controlling the electronic musical apparatus, the indicator element selecting keys 27, and the cursor keys 28 of FIG. 2*a*) via the bus 33 and sets music-playing conditions for the electronic musical apparatus, service requesting items for net browsing, music control parameters for a tone generator 41 and a sound system 42, and so forth.

The control programs cause the CPU 34 to execute steps for generating display screen images, steps for setting selected items, steps for transmitting and receiving data to and from the communication network 31.

A display device 39 (this corresponds to the display screen 26 of FIG. 2*a*, and indicator lamps corresponding to the controls) is to display menus for selection, parameter conditions as set by the setting controls 38, music scores, and so forth. A network interface 40 is to connect the electronic musical apparatus 1 to the communication network 31 to access the server apparatus 32. The tone generator 41 is to generate musical tone signals based on the music-playing data representing the real-time music-playing by means of the music-playing controls 37, or on automatic music performance data formed by playing back music performance data as downloaded from the server apparatus 32 to storage media 44 at an external storage device 43, or on music performance data being received in streaming playback, and outputs the generated musical tone signals to the sound system 42. The sound system 42 also outputs audible sounds from voice data of responding voice messages as transmitted from the server apparatus 32. The external storage device 43 is to store music performance data obtained from real-time music playing and music performance data downloaded from the server apparatus 32.

On the other hand, the server apparatus 32 has a similar hardware configuration as a personal computer. A CPU 46 executes operating system programs and application programs stored in an external storage device 51 such as a hard magnetic disk drive via a bus 45, and controls various controls 49, a display device 50 and a network interface 52 using a RAM 48 to realize the function of a server on the network. A ROM 47 stores programs for basic input/output system and information about the system configuration.

The external storage device 51 stores the apparatus and user administrative information shown in FIG. 3. The external storage device 51 also stores data base of music data (performance data) and delivers the music data as requested by the electronic musical apparatus 1 for downloading at the electronic musical apparatus 1 or outputs a streaming playback of the requested music performance. Further, it stores voice waveform data to output phonetic syllables, words, phrases, etc. for responding to a client in voice. Those which are necessary for the contents of response are retrieved, and edited into voice messages, and transmitted to the client electronic musical apparatus 1.

The control programs for the server apparatus 32 cause the CPU 46 to execute a step of transferring data to generate the display screen images, a step of accepting requests of selected service items, a step of supplying the requested service to realize the functions of the respective blocks of the electronic musical apparatus 1 as shown in FIG. 1 using the above described hardware configuration.

FIGS. 5*a* and 5*b* show, in combination, a flow chart describing an example of the operation of the server apparatus 32 as an embodiment of the present invention. The process flow will start upon power-on of the server apparatus 32. At a step S61, the initialization of the apparatus takes place.

A step 62 judges whether there is a new connection request from a user. In case there is such a request from a new user, the process flow goes forward to a step S3 for the connection processing. If not, the process goes back again to detect a new connection request. After the connection is established, a step S64 accepts ID data (e.g. a combination of the electronic musical apparatus ID and the user ID as shown in FIG. 3*a* above), and then a step S65 conducts authentication of the user as to whether the accessing user is a registered user by referring to the apparatus and user administrative information stored in the server apparatus 32.

A step S66 acquires the user's name based on the ID data, generates a voice response message for the user expressly including the user's name, to transmit to the electronic musical apparatus 1 requesting the connection.

Further, a step S67 (FIG. 5*b*) acquires the present time-of-day, and generates a greeting voice response message for the present time-of-day based on the acquired present time-of-day, and transmits to the accessing electronic musical apparatus 1.

Alternatively, the voice waveform data such as of voice syllables, words and phrases (e.g. "Good morning.") may be stored at the user's side, and the server may simply transmit triggering (i.e. designating) data to read out such data to be sounded at the user's side and/or some text data for presentation in letters.

Thereafter, a step S68 transmits display screen image data to present a menu of available services as shown in FIG. 2*b*. A step S69 accepts the user's request of the service item as selected by the user, and a step S70 supplies the requested service to the user.

When the network service is terminated or the server apparatus 32 receives a command of termination request from the electronic musical apparatus 1, a step S71 will direct the flow back to the step S62 (FIG. 5*a*) to bring the server apparatus to a standby. When the step S62 does not detect a termination command, the process flow proceeds back to the step S68 to continue further service transmission.

FIGS. 6*a*, 6*b*, 6*c*, 6*d* and 6*e* show, in combination, a flow chart describing an example of the main routine operation of an electronic musical apparatus as an embodiment of the present invention. The process flow will start upon power-on of the electronic musical apparatus 1. At a step S81, the initialization of the apparatus takes place.

A step 82 judges whether there is any input from the setting controls 38 (FIG. 4*a*). If there is an input, the process flow proceeds to a step S83 and succeeding steps, and if not, to a step S84 (FIG. 6*c*). The step S84 judges whether there is any data received from the server apparatus 32. If any data is received, the process flow proceeds to a step S85 and succeeding steps, and if not, to a step S86 (FIG. 6*e*). The step S86 judges whether there is any input from the music-playing controls 37 (FIG. 4*a*). If there is an input, the process flow proceeds to a step S87 and succeeding steps for generating musical tone signals, and if not, back to the step S82.

The step S83 (FIG. 6*a*) judges whether a start of a net service use is selected (commanded). If the judgment is affirmative (YES), the process flow goes forward to a step S 88 to connect to the network to access a particular aimed server apparatus 32. For example, when the indication element of "Internet Connection" (not shown) is on the display screen 26, the user actuates the corresponding indication element selecting key, and thereafter display screen image data is transmitted from the server apparatus 32 so that the display screen exhibits the screen image, for example, as shown in FIG. 2*a*, of thus received screen image data as processed at a step S97 or S99 as will be described herein later. After the network connection, a step S89 let the user input the ID data or reads out the ID data set in the electronic musical apparatus to transmit the ID data to the server apparatus 32 before conducting the succeeding process at the step S84.

If the input from the setting control 38 is of the termination of the net service, the step S83 judges negative (NO) and a step S90 judges affirmative (YES), and then a step S91 transmits a termination command to the server apparatus 32 and disconnects the electronic musical apparatus 1 from the network 31. The process flow then goes forward to the step S84. If the input from the setting control 38 is of neither the start nor the termination of the net service, the process flow moves forward to a step S92 (FIG. 6*b*) to judge whether the input is of a shared control (such as one of the indication element selecting controls 27*a*-27*f* and 27'1-27'5). If the judgment is negative (NO), the process flow goes to a step S93 to perform the selected or commanded item for the electronic musical apparatus 1 per se such as setting tone colors and controlling the start/stop of the automatic music performance before moving to the step S84 (FIG. 6*c*). If the input is of a shared control, the process flow goes to a step S94 to judge whether the electronic musical apparatus 1 is being connected to the network 31. If not, the process flow goes to the step S93. In connection with the conventional Web pages, selection (designation) will be done by using the pointer on the screen in place of the shared controls. If the electronic musical apparatus 1 is being connected to the network 31, the step S94 judges affirmative (YES) and then a step S95 sets the selected item for the network mode as selected by the shared control. Then, a step S96 transmits a request of the selected item to the server apparatus 32 before going to the step S84 (FIG. 6*c*).

When the display screen image designating data is received, both the steps S84 and S85 judges affirmative (YES), and the process flow proceeds further to a step S97 to read out the designated screen image data from the storage device of the electronic musical apparatus 1 and displays the same on the display screen 26. When the received data is not display screen image designating data, the process flow moves to a step S98 to judge whether the data is display screen image data. If so, the process flow proceeds to a step S99 to renew the display screen 26 with the received display screen image data before going to the step S86 (FIG. 6*e*).

When the received data is audio data (waveform data or compressed waveform data), a step S100 (FIG. 6*d*) judges affirmative (YES) and then a step S101 converts this digital audio data to an analog waveform signal to emit audible sounds (voices or tones) from the loudspeaker (in 42). The user can thus hear the voice response message. Then the process flow proceeds to the step S86 (FIG. 6*e*). If the received data is not audio data, the process flow goes to a step S102 to judge whether the data is audio output selecting data. If the judgment is affirmative (YES), a step S103 reads out from the storage device the audio data as designated by the audio output selecting data, converts the same into an analog audio signal. Thus the user can hear the voice response message from the server apparatus 32. The process flow then proceeds to the step S86 (FIG. 6*e*). If the received data is not audio output selecting data, the process flow goes to a step S104 to perform other processing such as downloading music performance data or music score data according to the received data content before proceeding to the step S86 (FIG. 6*e*).

Referring to FIG. 6*e*, if there is any input from the music-playing controls 37 (FIG. 4*a*), the step S86 judges affirmative (YES), and then a step S87 generates musical tone signals corresponding to the actuation of the music-playing controls 37. When the input is a key-on event, a musical tone having a pitch corresponding to the actuated music-playing key will starts to be generated, whereas when the input is a key-off event, the musical tone of the designated pitch is stopped. Next, a step S105 judges whether the user is practicing playing music on the electronic musical apparatus 1 (which is in the lesson mode), and if so, the process flow goes to a step S106 to transmit the performance data of the user to the server apparatus 32, and then the process flow goes back to the step S82 (FIG. 6*a*). If the user is not practicing, the process flow skips the step S106 and goes back to the step S82. As long as the power of the electronic musical apparatus is kept on, namely until the power is turned off, the above described processing will continue.

In the above description, the server apparatus 32 transmits to the electronic musical apparatus 1 display screen image data of the selectable service items about the available services from the server apparatus 32. With respect to the display screen image for selecting function items of the electronic musical apparatus 1 per se, the display screen image data or display screen image designating data may be supplied from the server apparatus 32. In such a case, the server apparatus 32 is to acquire the ID data (model ID and/or user ID, etc.), selects display screen image data which is adapted for the requesting user based on the acquired ID data, and supplies thus selected display screen image data to the electronic musical apparatus 1.

While the above description has been made with respect to an embodiment in the form of a keyboard electronic musical instrument, the electronic musical apparatus may be of a stringed musical instrument type, a wind musical instrument type, a percussion musical instrument type, or else. Further, the electronic musical apparatus may be an effector or a sequencer having no music-playing input device. The electronic musical apparatus may not necessarily be of an integrated type incorporating a tone generator, an automatic music performance device, etc. in a single main body, but may be configured by interconnecting separate units to operate as an integrated system. The present invention will be applicable to a karaoke apparatus, a game apparatus, a portable communication terminal such as a cellular phone, a player piano, and so forth.

As will be apparent from the above detailed description, according to the present invention, an electronic musical apparatus can work as a client apparatus to be connected to a communication network to utilize net services as on a personal computer.

While particular embodiments of the invention and particular modifications have been described, it should be expressly understood by those skilled in the art that various modifications and substitutions may be made without departing from the spirit of the present invention so that the invention is not limited thereto, since further modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. An electronic musical apparatus connectable to a server through a public communication network for communicating data, the apparatus comprising:

a communication device configured to transmit to the server a connection request through the public communication network and ID data that identify at least either one of the model or user of the electronic musical apparatus through the public communication network, and to receive from the server display screen data including service items that meet requirements of the model or user identified by the ID data, the service items representing network services available from the server for the model or the user;

a display screen having peripheral edges;

a plurality of selecting controls arranged in the vicinity of the peripheral edges of the display screen;

a display screen image generating device that generates a screen image to be displayed on the display screen based on the received screen display data, the screen image containing a plurality of indicator elements correspondingly exhibited near the selecting controls for selection by a user, each of the indicator elements showing one of the service items available to the electronic musical apparatus from the server through the public communication network, the screen image of the indicator elements showing the service items based on the received display screen data for selection of the network services available from the server; and an item selection determining device that determines the service item to be provided according to the selection by the user from among the service items representing the network services to be accessed through the public communication network to the electronic musical apparatus, wherein the communication device transmits to the server a request of the network service represented by the service item shown in the indicator element selected by the user and receives from the server the network service corresponding to the requested network service item.

2. An electronic musical apparatus as claimed in claim 1, wherein the indicator elements are allocated with the service items individually, wherein an intended service item is selected by operating the selecting control arranged near the corresponding indicator element representing the intended service item.

3. An electronic musical apparatus as claimed in claim 1, wherein the indicator elements are provided for sequentially exhibiting the service items one after another, wherein an intended service item is selected by affirming one of the exhibited service items.

4. An electronic musical apparatus as claimed in claim 1, further comprising a pointing device that causes a pointer to move in the screen image, wherein the communication device receives data for the screen image including an embedded link destination, causes the display screen image generating device to display the screen image including the embedded link destination, causes the item selection determining device to determine the embedded link destination as the selected item when pointed by the pointer, and permits access to the determined link destination.

5. A storage medium for use in an electronic musical apparatus of a data processing type including a processor, a display screen having peripheral edges, a plurality of selecting controls arranged in the vicinity of the peripheral edges of the display screen, and a communication device connectable to a server through a public communication network for communicating data, the medium containing a set of executable instructions for:

transmitting to the server a connection request through the public communication network and ID data that identify at least either one of the model or user of the electronic musical apparatus through the public communication network;

receiving from the server display screen data including service items that meet requirements of the model or user identified by the ID data, the service items representing network services available from the server for the model or the user;

generating a screen image to be displayed on the display screen based on the received display screen data, the screen image containing a plurality of indicator elements correspondingly exhibited near the selecting controls for selection by a user, each of the indicator elements showing one of the service items available to the electronic musical apparatus from the server through the public communication network the screen image of the indicator elements showing the service items based on the received display screen data for selection of the network services available from the server;

determining the service item to be provided according to the selection by the user from among the service items representing the network services to be accessed through the public communication network to the electronic musical apparatus;

transmitting to the server a request of the network service represented by the service item shown in the indicator element selected by the user to the server; and receiving from the server the network service corresponding to the requested network service item.

* * * * *